US012305452B2

(12) United States Patent
Arsoski et al.

(10) Patent No.: US 12,305,452 B2
(45) Date of Patent: May 20, 2025

(54) CENTRALIZER HAVING INTERNAL STOP COLLAR

(71) Applicant: DOWNHOLE PRODUCTS LIMITED, Aberdeen (GB)

(72) Inventors: Darko Arsoski, Angus (GB); Douglas Brian Farley, Missouri City, TX (US); Shenal Mekson, Antioch, IL (US)

(73) Assignee: DOWNHOLE PRODUCTS LIMITED

( * ) Notice: Subject to any disclaimer, the term of this patent is extended or adjusted under 35 U.S.C. 154(b) by 0 days.

(21) Appl. No.: 18/773,846

(22) Filed: Jul. 16, 2024

(65) Prior Publication Data

US 2025/0109640 A1 Apr. 3, 2025

Related U.S. Application Data

(60) Provisional application No. 63/587,459, filed on Oct. 3, 2023.

(51) Int. Cl.
*E21B 17/10* (2006.01)
*E21B 17/00* (2006.01)

(52) U.S. Cl.
CPC ..... *E21B 17/1078* (2013.01); *E21B 17/006* (2013.01); *E21B 17/1028* (2013.01)

(58) Field of Classification Search
CPC .... E21B 17/1078; E21B 17/10; E21B 17/006; E21B 17/16; E21B 17/043; E21B 17/1028; E21B 7/024; E21B 10/30
See application file for complete search history.

(56) References Cited

U.S. PATENT DOCUMENTS

| | | | | |
|---|---|---|---|---|
| 4,101,179 | A | 7/1978 | Barron | |
| 5,860,760 | A | 1/1999 | Kirk | |
| 6,006,830 | A | 12/1999 | Barron | |
| 7,694,733 | B2 | 4/2010 | Clark | |
| 8,511,377 | B2 | 8/2013 | Casassa | |
| 8,863,834 | B2 | 10/2014 | Buytaert | |
| 9,534,456 | B2 | 1/2017 | Eidem | |
| 9,598,913 | B2 * | 3/2017 | Buytaert | E21B 17/1078 |
| 9,963,942 | B2 * | 5/2018 | Eidem | E21B 17/105 |
| 9,982,494 | B2 * | 5/2018 | Steine | E21B 17/12 |
| 10,385,637 | B2 * | 8/2019 | Marr | E21B 23/00 |

(Continued)

OTHER PUBLICATIONS

The Ace Team, Quick, Safe, and Flexible installations, www.acewelltechnology.com/post/quick-safe-and-flexible-installations, May 25, 2021 (Updated: Aug. 7), 2 pages.

*Primary Examiner* — Yong-Suk (Philip) Ro

(57) ABSTRACT

A centralizer for mounting onto a downhole tubular incudes a cylindrical body. The body has: a plurality of blades forming a periphery thereof, a first portion with an inner surface, and a second portion having a groove formed in an inner surface thereof for receiving a stop collar. The stop collar includes: a compressible slip ring having teeth formed in an inner surface thereof and a pair of tapered outer surfaces, and a pair of cam rings, each cam ring having a tapered inner surface. An outer diameter of each cam ring is greater than a diameter of the inner surface of the first portion and less than a diameter of the groove. An assembly tool is operable to drive the tapered surfaces together, thereby compressing the slip ring such that the teeth engage a periphery of the downhole tubular.

12 Claims, 6 Drawing Sheets

(56) References Cited

U.S. PATENT DOCUMENTS

| | | | | |
|---|---|---|---|---|
| 10,851,600 | B2 | 12/2020 | Steine | |
| 11,286,729 | B2 | 3/2022 | Mackay | |
| 11,536,095 | B2 | 12/2022 | Arsoski | |
| 2020/0109607 | A1* | 4/2020 | Mackay | E21B 17/1078 |

* cited by examiner

CENTRALIZER HAVING INTERNAL STOP COLLAR

BACKGROUND OF THE DISCLOSURE

Field of the Disclosure

The present disclosure generally relates to a centralizer having an internal stop collar.

Description of the Related Art

U.S. Pat. No. 4,101,179 discloses a rigid stabilizer sleeve having outwardly extending ribs is slideably received over a drill collar. A pair of internal clamping rings are slideably received through each end of the rigid main sleeve. As a threaded end cap is threaded into the rigid main sleeve, the end clamp forces one ring of the pair against the other thereby producing a clamping effect whereby the stabilizer can be clamped at any desired position on the drill collar. An outer ring of the pair of rings has a groove and a rib disposed on its interior cylindrical surface; the portion of the end clamp received by the outer ring has a rib and a groove disposed upon its outer cylindrical surface. As the end cap receives the outer ring, the rib and the groove of the end cap interlock with the groove and the rib respectively of the outer ring whereby when the end cap is threadedly removed from the rigid main sleeve, the outer ring follows the end cap and is disengaged from the inner ring, thereby unclamping the pair of rings from the drill collar.

U.S. Pat. No. 5,860,760 discloses a gripping device which has an inner member and an outer member. The inner member has a split which define a first end and a second end. A selectively operable device is also included to keep the first and second ends apart to permit the device to be placed around an object and to permit the first and second ends to move towards each other so that the inner member grips the object. At least part of an outer face of the inner member interfits with at least a part of an inner face of the outer member in a manner such that when a load is applied to the outer member, the inner face of the outer member acts upon the inner member to cause compression of the inner member thereby increasing the grip of the inner member on the object. The device is then locked in position on the object and when the load is removed the action of the outer member on the inner member is reduced thereby decreasing the grip of the inner member on the object and unlocking the device from the object.

U.S. Pat. No. 6,006,830 discloses a casing centralizer including an annular body and a substantially cylindrical bore extending longitudinally through the body. A number of blades extend longitudinally along the body and are circumferentially distributed around the body to define a flow path between each adjacent pair of blades. Each flow path provides a fluid flow path between longitudinally opposite ends of the centralizer and each blade has a radially outer edge providing a well bore contacting surface. The cylindrical bore through the body is a clearance fit around casing intended to be centralized by the centralizer. The centralizer is typically manufactured from a material which includes zinc and is preferably a zinc alloy.

U.S. Pat. No. 7,694,733 discloses a centralizer having a body with an inner surface provided with a friction-reducing slider, typically located in an annular recess on the inner surface of the body of the slider, spaced from the ends of the body. The slider can be formed separately from a body of the centralizer and subsequently attached thereto on the inner surface so that it is adapted to bear between the outer surface of the tubing to be centralized and the inner surface of the centralizer. This reduces rotational torque transmitted between the centralizer and the tubing, and assists in maneuvering of the tubular string into the desired position in the well.

U.S. Pat. No. 8,511,377 discloses a non-rotating downhole sleeve adapted for open hole drilling and/or casing centralization. The sleeve includes a tubular body made of hard plastic with integrally formed helical blades positioned around its outer surface and an inner surface configuration which allows drilling fluid circulation to form a non-rotating fluid bearing between the sleeve and the drill pipe or casing. The helical blades reduce sliding and rotating torque while drilling, with minimal obstruction to drilling fluid passing through the borehole between the blades.

U.S. Pat. No. 8,863,834 discloses a wear band including a rotating element having a bore receivable on a tubular, the bore including first and second bore portions slidably receiving first and second sleeve bearings. Outer surfaces of the sleeve bearings slidably engage the bore portions and the bores of the sleeve bearings slidably engage the tubular. A first stop collar and a second stop collar may be received on the tubular to together straddle the rotating element and sleeve bearings to longitudinally secure the rotating element in a position on the tubular. The tubular may be included within a tubular string run into a borehole or into the bore of an installed casing, such as in casing while drilling. The rotating element provides stand-off between a tubular and the wall of a bore, reduces frictional resistance to longitudinal sliding and also to rotation of the tubular string within the bore.

U.S. Pat. No. 9,534,456 discloses a centralizer including a centralizer body to be situated at the outer surface of a pipe string in the form of casing, liner, or the like used while drilling, the centralizer body being formed with a plurality of outer centralizer blades arranged in an inclined manner to the longitudinal axis thereof, wherein the centralizer body has an separate split inner tube secured to the pipe string by means of a press fit, and low friction inner surface of the centralizer body and separate center tube facing each other are made from low friction material.

U.S. Pat. No. 10,851,600 discloses a method of connecting an end part of a pipe attachment device to a part of a function element, includes: aligning longitudinal axes of a substantially tubular end part of a pipe attachment device and a substantially tubular part of a function element; applying a force that moves the end part of the pipe attachment device relatively towards the part of the function element along the longitudinal axis. Contact between the end part of the pipe attachment device and the part of the function element causes each of a plurality of fingers on the end part to elastically deflect. Applying the force so that each of the plurality of fingers on the end part returns from their deflected position and is retained in one or more holes in the part of the function element.

U.S. Pat. No. 11,286,729 discloses a stop collar for mounting to a downhole tubular including: a cylindrical housing having a threaded inner surface and a tapered inner surface; a compressible slip ring having teeth formed in an inner surface thereof and a pair of tapered outer surfaces; a compressible cam ring having a tapered inner surface; and a cylindrical bolt having a threaded outer surface. A natural outer diameter of each ring is greater than a minor diameter of the threaded surfaces. Screwing the threaded surfaces of the housing and the bolt is operable to drive the tapered surfaces together, thereby compressing the slip ring such that the teeth engage a periphery of the tubular.

U.S. Pat. No. 11,536,095 discloses a stop collar for mounting to a downhole tubular including: a cylindrical housing having a threaded inner surface and a tapered inner surface; a compressible slip ring having teeth formed in an inner surface thereof and a pair of tapered outer surfaces; a solid cam ring having a tapered inner surface; and a cylindrical bolt having a threaded outer surface. A natural outer diameter of each ring is greater than a minor diameter of the threaded surfaces. Screwing the threaded surfaces of the housing and the bolt is operable to drive the tapered surfaces together, thereby compressing the slip ring such that the teeth engage a periphery of the tubular.

The Ace Well Technology website has an article entitled "Quick, safe and flexible installations" which discloses a hand-held press and a hydraulic power unit for installation of a stop collar.

SUMMARY OF THE DISCLOSURE

The present disclosure generally relates to a centralizer having an internal stop collar. In one embodiment, a centralizer for mounting onto a downhole tubular incudes a cylindrical body. The body has: a plurality of blades forming a periphery thereof, a first portion with an inner surface, and a second portion having a groove formed in an inner surface thereof for receiving a stop collar. The stop collar includes: a compressible slip ring having teeth formed in an inner surface thereof and a pair of tapered outer surfaces, and a pair of cam rings, each cam ring having a tapered inner surface. An outer diameter of each cam ring is greater than a diameter of the inner surface of the first portion and less than a diameter of the groove. An assembly tool is operable to drive the tapered surfaces together, thereby compressing the slip ring such that the teeth engage a periphery of the downhole tubular.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1A:
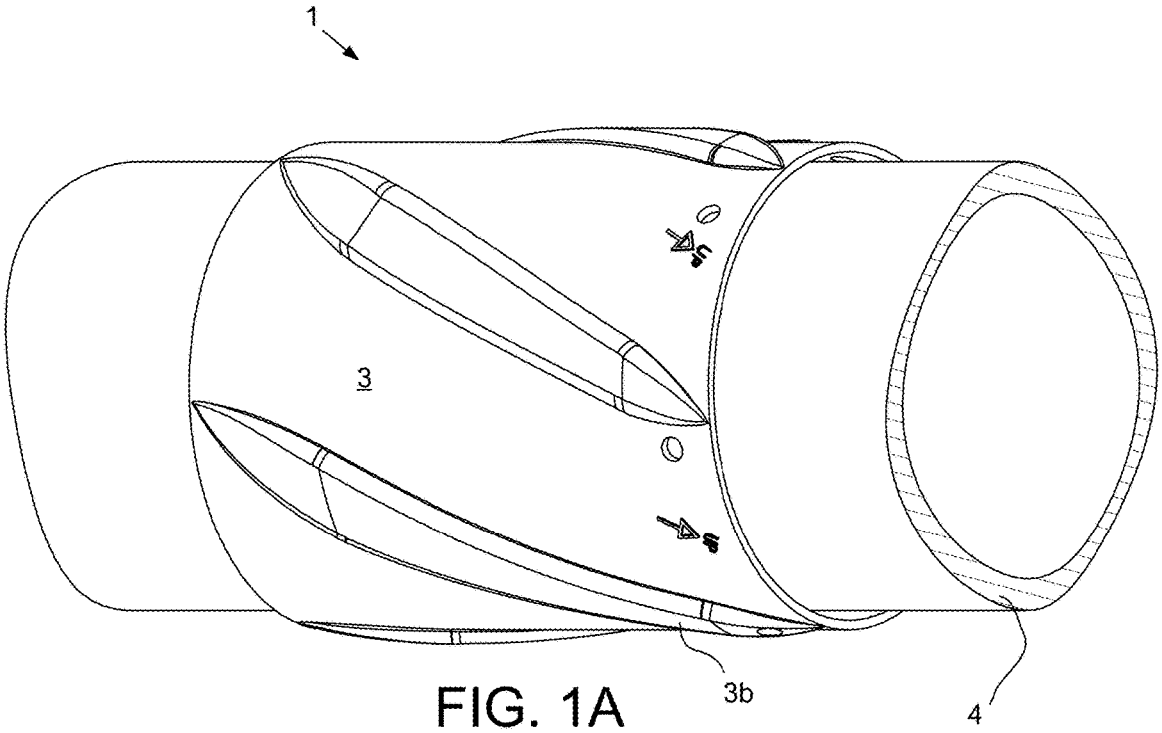
FIGS. 1A and 1B illustrate a centralizer equipped with an internal stop collar, according to one embodiment of the present disclosure.
Figure 1B:
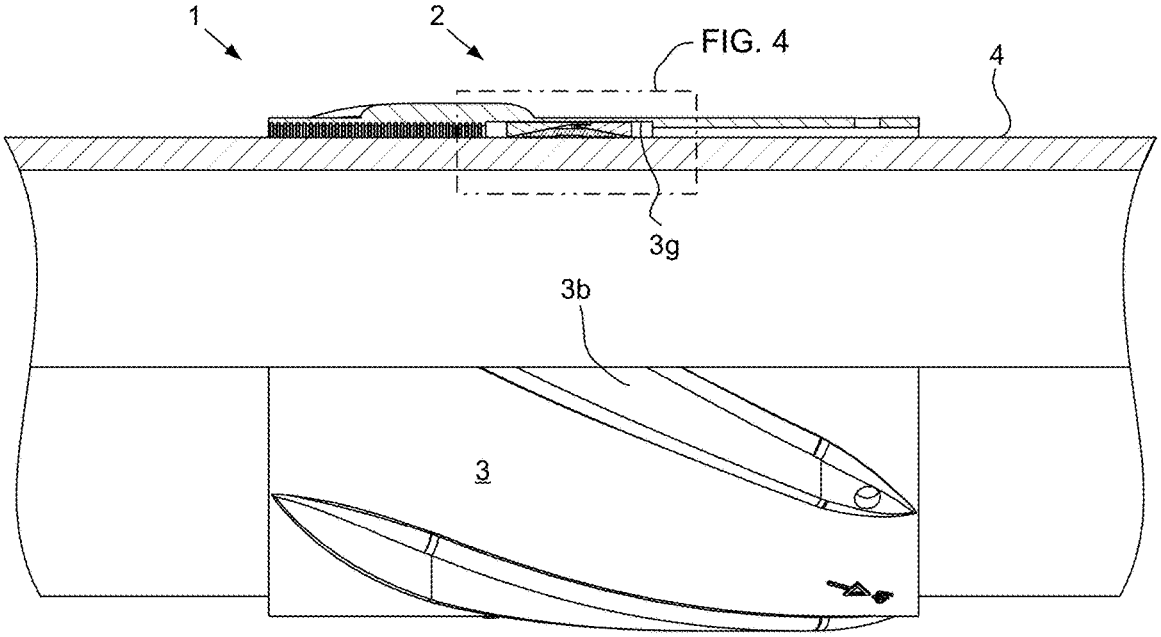

FIGS. 1A and 1B illustrate a centralizer 1 equipped with an internal stop collar 2, according to one embodiment of the present disclosure. The centralizer 1 may include the stop collar 2 and a body 3. The stop collar 2 may be mounted to the downhole tubular 4, such as casing or liner. The stop collar 2 may be disposed in a groove 3*g* of the body 3, thereby mounting the body 3 to the downhole tubular 4 while allowing for relative rotation between the body and the downhole tubular.

Figure 6A:
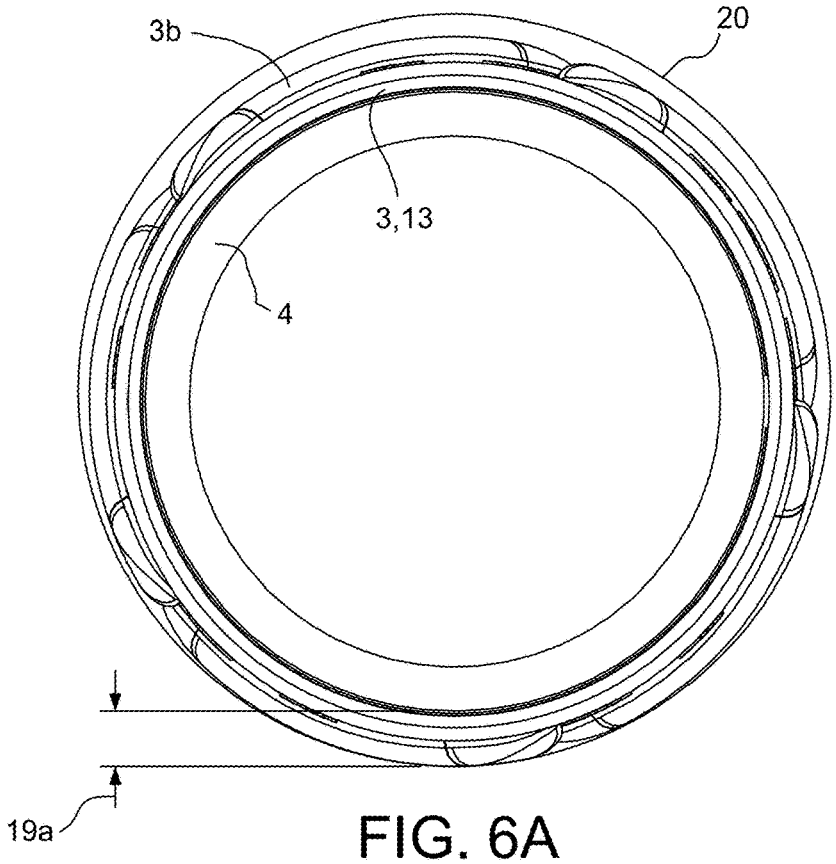
FIGS. 6A and 6B illustrate improved standoff capability of the centralizers as compared to a prior art centralizer.

The body 3 may be cylindrical and have a plurality, such as five (four shown), of blades 3*b* forming a periphery of the centralizer 1 and extending helically along the body. The body 3 and blades 3*b* may be made from a metal or alloy, such as steel, cast iron, or non-ferrous material (neglecting impurities), such as zinc or zinc-based alloy. The centralizer 1 may be a solid body centralizer (aka rigid centralizer). The blades 3*b* and the body 3 may be of one-piece construction, such as integrally formed by casting. The body 3 may have a longitudinal bore formed therethrough and the bore may have a minimum inner diameter dimensioned to form a clearance fit around the downhole tubular 4. The blades 3*b* may each extend between longitudinal ends of the body 3 and may be spaced around the body at regular intervals. The helical skew of the blades 3*b* may ensure that their respective outer edges collectively provide circumferential coverage for contacting a wellbore 20 (FIG. 6A).

Each blade 3*b* may have a constant thickness mid portion and a pair of end portions. Each end portion may taper from a greater thickness and a greater width of the respective blade 3*b* at an interface with the respective mid portion to a lesser thickness and a lesser width at the respective end of the body 3. A width of the mid portion of each blade 3*b* may also taper from larger to smaller as the respective mid portion extends from a lower portion thereof to an upper portion thereof. To facilitate assembly by a field technician, one or more visual indicators, such as arrows UP, may be formed in an outer surface of the body 3 between the blades 3*b* and may point toward the upper end of the body. A width of each blade 3*b* may also taper radially from larger at an inner base of the respective blade to smaller at the outer edge thereof.

Alternatively, the blades 3*b* may be formed separately from the body 3 and bonded thereto or formed onto the body. Alternatively, the body 3 may have an additional groove formed in an inner surface thereof and a slider disposed in the groove and made from a low friction material, such as polytetrafluoroethylene (PTFE), so that the slider is adapted to bear between the outer surface of the downhole tubular and the inner surface of the body. Alternatively, each blade 3*b* may have inserts disposed in and along the outer edge thereof and the inserts may be made from the low friction material.

A plurality of the centralizers 1 may each be mounted along a string of downhole tubulars 4, such as a casing or liner string. An upper section of the wellbore 20 may have been previously drilled and lined with a casing or liner string secured into the wellbore with cement (not shown). A lower section of the wellbore 20 may have then been drilled toward and/or to a hydrocarbon-bearing formation (not shown). The lower section of the wellbore 20 may be vertical or deviated, such as inclined or horizontal. The centralizers 1 may each be mounted to the downhole tubular 4 (using the stop collar 2) along at least a portion thereof that will be cemented into the wellbore 20. The centralizers 1 may be spaced along the portion of the downhole tubular 4 at regular intervals. The centralizers 1 maintain a neutral position of the downhole tubular 4 in the wellbore 20 to ensure that a uniform cement sheath is formed around the downhole tubular during the cementing operation. Rotation of the downhole tubular 4 relative to the centralizer body 3 (and the wellbore 20) during the cementing operation facilitates improved quality of the cement.

Figure 2:
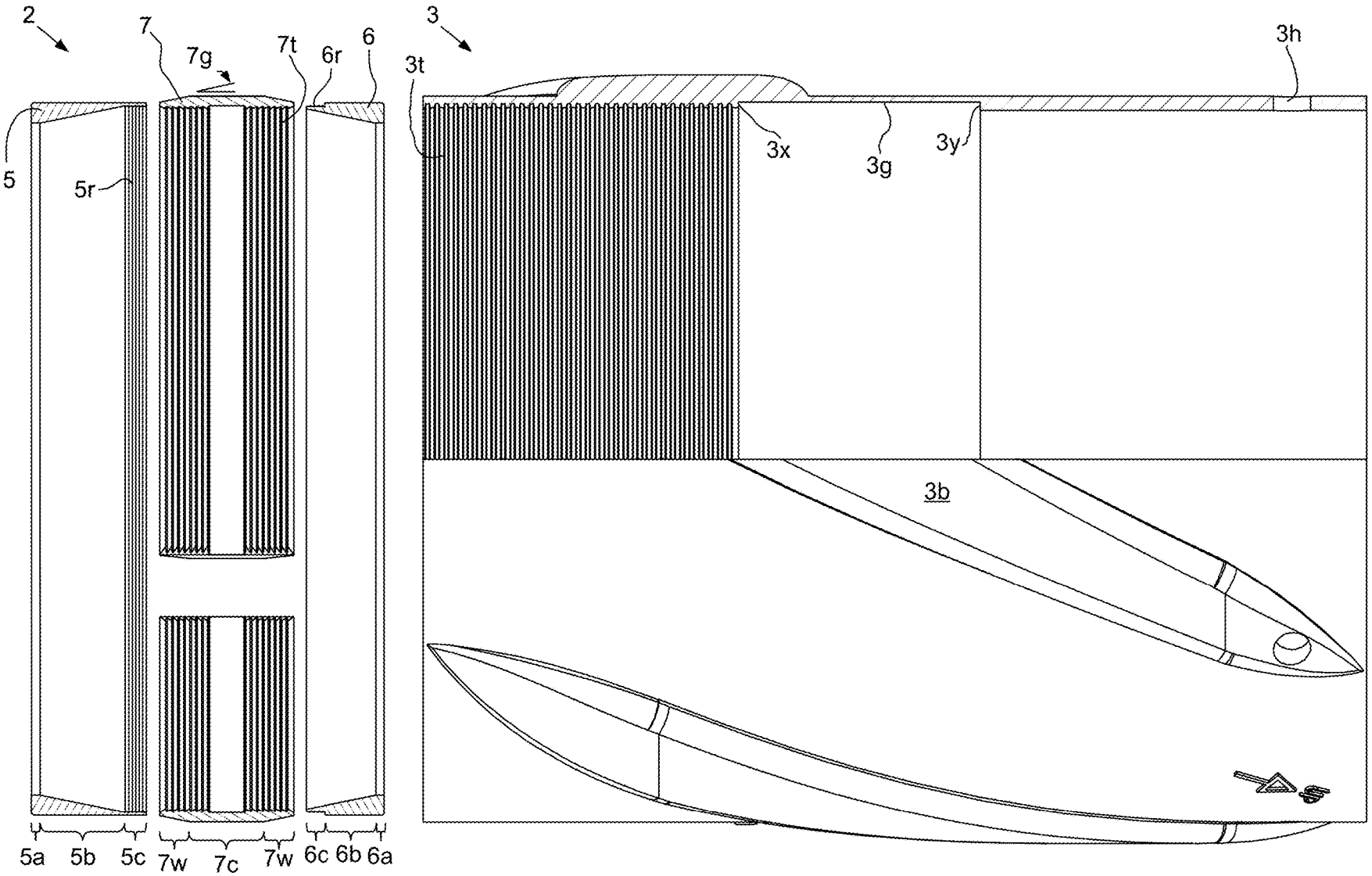
FIG. 2 illustrates an arrangement of the centralizer.

FIG. 2 illustrates an arrangement of the centralizer 1. The stop collar 2 may include a pair of first 5 and second 6 cam rings, a slip ring 7, and a locking system 8. Each cam ring 5,6 may be solid meaning that each cam ring 5,6 has a solid wall (no slots) and is not split. Each of the components 5-8 may be made from a metal or alloy, such as steel. The locking system 8 may include a ratchet profile 5*r* of the first cam ring 5 and a ratchet profile 6*r* of the second cam ring 6*r*.

Alternatively, if the cam rings 5,6 and body 3 are made from different materials, then the cam rings and/or the body may be surface treated, such as nitrided, or coated to reduce galvanic potential.

Figure 3A:
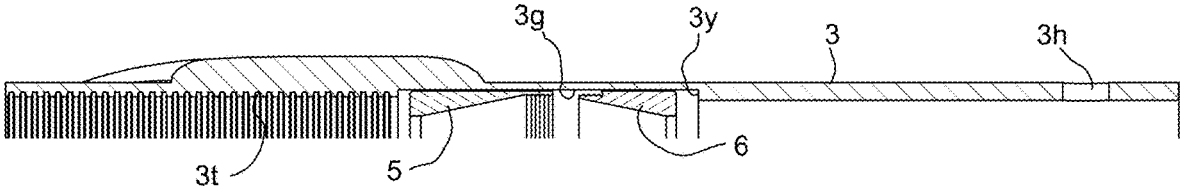
FIGS. 3A and 3B illustrate assembly of the stop collar within a body of the centralizer.
Figure 3B:
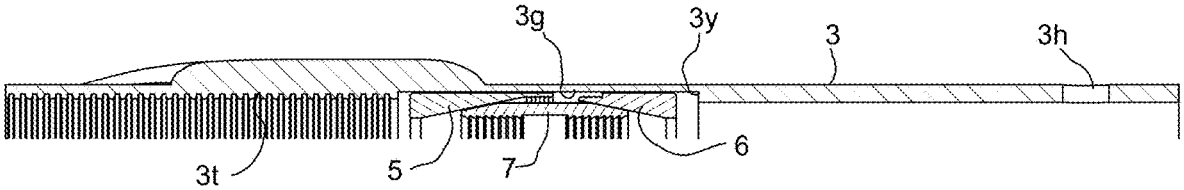
Figure 3C:
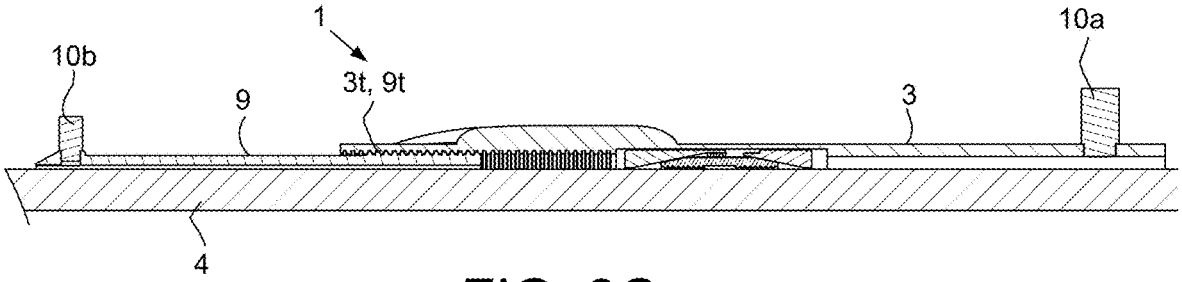
FIGS. 3C and 3D illustrate actuation of the stop collar into engagement with a downhole tubular.

The body 3 may have a lower portion extending from the lower end thereof and having a threaded inner surface 3*t* for receiving an assembly tool 9 (FIG. 3C). The inner thread 3*t* of the lower portion may be for mating with a threaded outer surface 9*t* of the assembly tool 9. The forms of the threads 3*t*,9*t* may be lead screws for driving engagement of the slip ring 7 with a periphery of the downhole tubular 4. The body 3 may further have a mid portion located between the lower portion and an upper portion thereof, having the groove 3*g* formed in an inner surface thereof, bounded by a pair of stop shoulders 3*x*,3*y*, and having an enlarged constant inner diameter due to the groove. The minor diameter of the threads 3*t*,9*t* may be less than the inner diameter of the mid portion of the body 3. The body 3 may further have the upper portion extending from the upper end thereof and having a constant and reduced inner diameter. The body 3 may also have a plurality of holes 3*h* formed through a wall of the upper portion for facilitating assembly (discussed below).

Alternatively, the thread 3*t* may be located along the upper portion of the body 3 and the lower portion thereof may have the constant and reduced inner diameter.

Figure 4A:
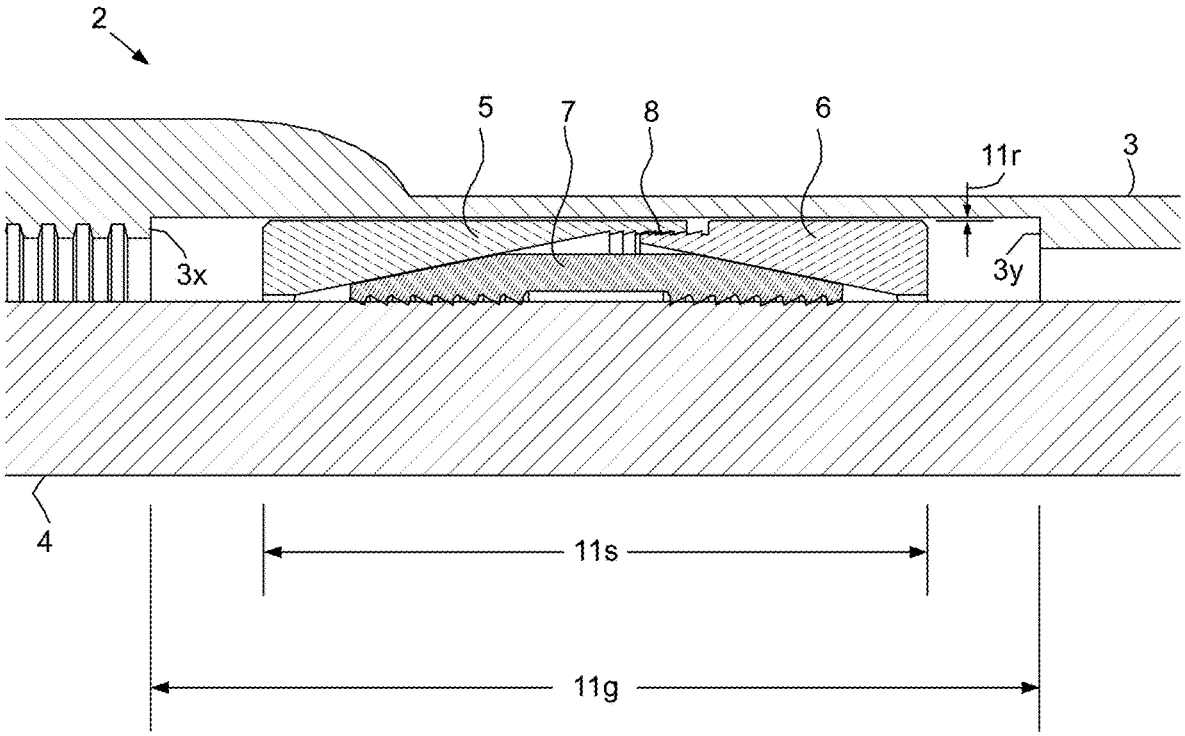
FIG. 4A is an enlargement of a portion of FIG. 1B.

The slip ring 7 may have a central portion 7*c* with a constant diameter outer surface and a pair of working portions 7*w*, each working portion having a tapered outer surface declining away from the central portion. The taper of each working portion 7*w* may have a taper angle 7*g* relative to an axis parallel to a longitudinal axis of the downhole tubular 4 which may range between five and twenty-five degrees. An inner surface of each working portion 7*w* may have a plurality of circumferential teeth 7*t* (aka wickers) formed therein. The teeth 7*t* may extend past the working portions 7*w* and along some of the central portion 7*c*. Each tooth 7*t* may have a cross sectional shape resembling a right triangle and the hypotenuses of the teeth of each working portion 7*w* may incline toward the central portion 7*c*, thereby providing bidirectional gripping of the downhole tubular 4. The slip ring 7 may be split (aka C-shape) for compression between a natural position (shown) and a compressed position (FIG. 4A). In the natural position, an outer diameter of the central portion 7*c* may be greater than a minor diameter of the threads 3*t*, 9*t* and roughly equal to the diameter of the groove 3*g*.

Alternatively, the slip ring 7 may be partially split by a plurality of slots extending radially through a wall thereof, each slot extending from one end of the slip ring, along the respective working portion 7*w* and the center portion 7*c*, and terminating in the other working portion before reaching the other end of the slip ring. Alternatively, the teeth 7*t* of the slip ring 7 may all be inclined in the same direction, thereby providing only monodirectional gripping of the downhole tubular 4 and the slip ring may have an orientation indicator, such as an arrow, on a periphery thereof, such as by adhering, engraving, or painting. Alternatively, the teeth 7*t* of the slip ring 7 may all be inclined away from the central portion.

The first cam ring 5 may have a first portion 5*a* with a reduced inner diameter for engagement with an end of the assembly tool 9 and the first stop shoulder 3*x*, a second portion 5*b* with a tapered inner surface for engagement with one of the working portions 7*w* of the slip ring 7 and a third portion 5*c* with an enlarged inner diameter (both major and minor) and the ratchet profile 5*r* formed in an inner surface thereof. The first cam ring 5 may have a constant outer diameter (excluding a chamfer formed at each end thereof). The taper of the second portion 5*b* may correspond to the taper of the working portions 7*w* of the slip ring 7.

The second cam ring 6 may have a first portion 6*a* with a reduced inner diameter for engagement with the second stop shoulder 3*y*, a second portion 6*b* with a tapered inner surface for engagement with one of the working portions 7*w* of the slip ring 7 and a third portion 6*c* with a reduced outer diameter (both major and minor), the tapered inner surface, and the ratchet profile 6*r* formed in an outer surface thereof. The first and second portions 6*a*,*b* of the second cam ring 6 may have a constant enlarged outer diameter (excluding a chamfer formed at each end thereof). The taper of the second and third portions 6*b*,*c* may correspond to the taper of the working portions 7*w* of the slip ring 7.

The ratchet profiles 5*r*,6*r* may each include a plurality of circumferential teeth having radially straight portions and radially inclined portions and oriented such that during mating of the third portions 5*c*,6*c* of the first and second cam rings 5,6, each third portion is deflected away from the other by engagement of the inclined portions of the circumferential teeth and then allowed to snap back during engagement of the straight portions of the inclined teeth, thereby allowing movement of the first and second cam rings toward one another but preventing reverse movement thereof away from one another.

The metal or alloy of each cam ring 5,6 may possess sufficient resilience to allow elastic compression of the respective cam ring between a natural position (shown) and a compressed position (not shown). In the natural position, the outer diameter of each cam ring 5,6 may be greater than a minor diameter of the threads 3*t*, 9*t* and less than the diameter of the groove 3*g*.

FIGS. 3A and 3B illustrate assembly of the stop collar 2 within the body 3 of the centralizer 1. To begin assembly, the second cam ring 6 may be rotated such that a longitudinal axis thereof is perpendicular to a longitudinal axis of the body 3. The second cam ring 6 may be compressed so that a portion of the outer diameter thereof is less than or equal to the minor diameter of the thread 3*t* of the body 3. The compressed second cam ring 6 may then be inserted through the thread 3*t* and into the groove 3*g* of the body 3 until the compressed second cam ring engages the second stop shoulder 3*y* of the body. The compressed second cam ring 6 may then again be rotated until the longitudinal axis thereof is parallel to the longitudinal axis of the body 3. Such rotation may require some flexing of the second cam ring 6. Once rotated into place, the second cam ring 6 may then expand to the natural position thereof (compression is solely elastic, not plastic) and be slid along the groove until the second cam ring is in a desired assembly position. Once the second cam ring 6 has been properly positioned within the groove 3*g*, the first cam ring 5 may be manipulated and inserted into the groove 3*g* in a similar fashion as the second cam ring 6.

Alternatively, either or both of the cam rings 5,6 may be inserted into the body 3 via the upper end thereof instead of the lower end thereof. Alternatively, either or both of the cam rings 5,6 may be partially deformed while being inserted into the body 3 and at least partially deformed back towards its original shape, either prior to or during being positioned parallel to the longitudinal axis thereof (compression is partially plastic). Alternatively, the first cam ring 5 may be installed into the groove 3*g* before the second cam ring 6.

Once the first cam ring 5 has been properly positioned within the groove 3*g*, the slip ring 7 may be rotated such that a longitudinal axis thereof is at an acute angle to the longitudinal axis of the body 3. The slip ring 7 may then be inserted into the upper end of the body 3 until the non-inserted end of the slip ring 7 is adjacent to the upper end of the body. The slip ring 7 may then be compressed such that the non-inserted end of the slip ring may slide underneath the inner surface of the upper body portion and the second cam ring 6, and the non-inserted end of the slip ring may then be so slid, thereby rotating the slip ring into place into an annulus formed between the two cam rings 6,7 and in partial engagement with tapered inner surfaces thereof.

Alternatively, the slip ring 7 may be installed after the second cam ring 6 but before the first cam ring 5 or after the first cam ring but before the second cam ring.

Figure 3D:
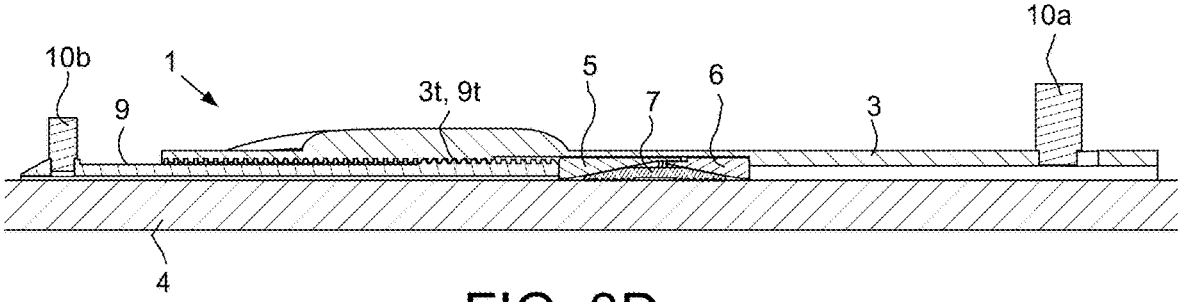

FIGS. 3C and 3D illustrate actuation of the stop collar 2 into engagement with the downhole tubular 4. Once the slip ring 7 has been properly positioned within the body 3, the thread 9*t* of the assembly tool 9 may be engaged with the body thread 3*t*. The assembly tool 9 may be cylindrical and have a head portion with an enlarged outer diameter and a shank portion with a reduced outer diameter. A portion of the shank portion of the assembly tool 9 distal from the head portion thereof may have the thread 9*t* formed in an outer surface thereof. The assembly tool 9 may also have a plurality of holes formed through a wall of the head portion for facilitating assembly. A first wrench, such as a spanner wrench 10*a*, may be inserted into one or more of the holes 3*h* of the body 3 and a second wrench, such as a spanner wrench 10*b*, may be inserted into one of the holes of the assembly tool 9. Using the wrenches 10*a*,*b*, the assembly tool 9 may be rotated relative to the body 3 in a tightening direction, thereby advancing the assembly tool toward the body until the threaded shank portion 9*t* thereof has entered the lower portion of the body. The wrenches 10*a*,*b* may be disengaged from the assembly tool 9.

The centralizer 1 with the disengaged stop collar 2 and the partially engaged assembly tool 9 may then be slid over the downhole tubular 4 until the centralizer is in a desired position along the downhole tubular 4. Once the disengaged stop collar 2 has been positioned along the downhole tubular 4, the wrenches 10*a*,*b* may be re-inserted into the respective holes 3*h* and the assembly tool 9 may be further rotated relative to the body 3 in the tightening direction, thereby further advancing the assembly tool into the body. During continued rotation of the assembly tool 9 relative to the body 3, an end of the shank portion of the assembly tool may engage the first end 5*a* of the of the first cam ring 5 and drive the first cam ring toward the slip ring 7, the slip ring toward the second cam ring 6, and the second cam ring toward the second stop shoulder 3*y*.

During continued rotation of the assembly tool 9 relative to the body 3, the first end 6*a* of the second cam ring 6 may engage the second stop shoulder 3*y* and the tapered second portion 5*b* of the first cam ring 5*a* may slide over the adjacent working portion 7*w* of the slip ring 7, thereby also driving the distal working portion thereof along the mating tapered surface of the second slip ring 6. During continued rotation of the assembly tool 9 relative to the body 3, the tapered second portion 5*b* of the first cam ring 5 may continue to slide over the adjacent working portion 7*w* of the slip ring 7 and advancement of the slip ring along the tapered inner surface of the second slip ring 6 may continue, thereby radially compressing the slip ring 7 toward the periphery of the downhole tubular 4. Radial compression of the slip ring 7 may continue until the teeth 7*t* thereof engage and penetrate the periphery of the downhole tubular 4, thereby longitudinally and torsionally mounting the stop collar 2 to the downhole tubular.

Alternatively, the step of partially engaging the assembly tool 9 may be omitted such that the centralizer 1 may be slid over the downhole tubular 4 without the partially engaged assembly tool 9, and the assembly tool 9 may be engaged with the centralizer 1 thereafter.

Also during continued rotation of the assembly tool 9 relative to the body 3, the teeth of the ratchet profile 5*r* may engage the teeth of the ratchet profile 6*r* as the first cam ring 5 is driven toward the second cam ring 6. Operation of the locking system 8 prevents movement of the cam rings 5,6 away from each other, which could be caused by vibration. Once the slip ring 7 has engaged the downhole tubular 4, rotation of the assembly tool 9 may be reversed until the thread 9*t* thereof disengages the thread 3*t* of the body. The wrenches 10*a*,*b* may be disengaged from the assembly tool 9 and the assembly tool removed.

FIG. 4A is an enlargement of a portion of FIG. 1B. To facilitate rotation of the downhole tubular 4 relative to the centralizer 1, a clearance 11*r* may be formed radially between an outer surface of the cam rings 5,6 and an inner surface of the mid portion of the body 3 defining the groove 3*g* due to a maximum outer diameter of the cam rings 5, 6 being less than a diameter of the groove. A cross-sectional shape of the groove 3*g* may be rectangular. The clearance 11*r* may be sufficient so that the downhole tubular 4 may rotate freely relative to the centralizer body 3, such as at least being a sliding engineering fit. A length 11*g* of the groove 3*g* may be greater than an engaged length 11*s* of the stop collar 2, thereby forming a gap between the stop collar and the stop shoulders 3*x*,*y*. The gap allows for limited longitudinal movement of the downhole tubular relative to the body 3.

Advantageously, the clearance 11*r* may allow the downhole tubular 4 to rotate freely relative to the centralizer body 3 without requiring a radial bearing, such as a bearing sleeve.

Figure 4B:
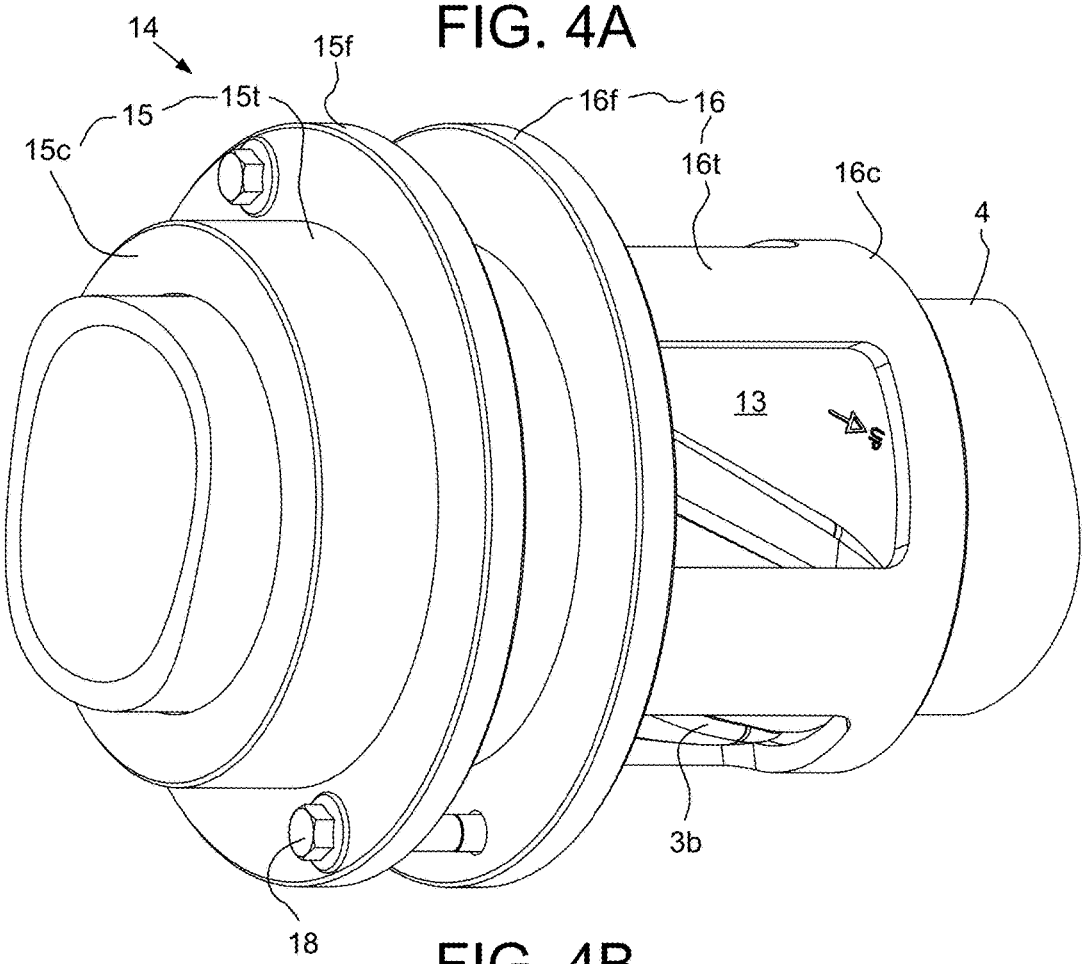
FIGS. 4B and 5A illustrate actuation of the stop collar within a body of a second centralizer, according to another embodiment of the present disclosure.
Figure 5A:
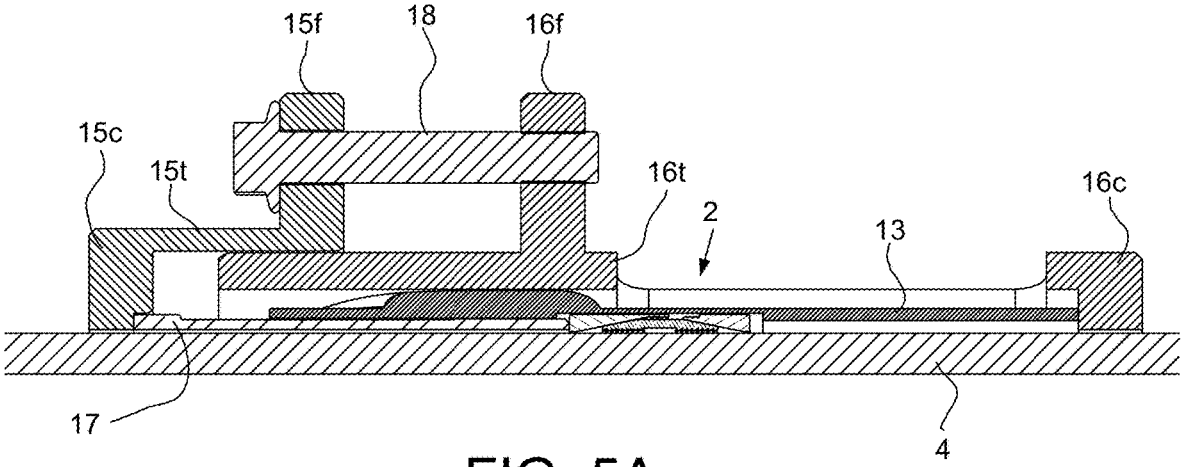

FIGS. 4B and 5A illustrate actuation of the stop collar 2 within a body 13 of a second centralizer 12, according to another embodiment of the present disclosure. The second centralizer 12 may be similar or identical to the (first) centralizer except for omission of the inner thread 3*t* from the body 13 thereof and omission of the wrench holes 3*h* from the body thereof. The second centralizer 12 may include the stop collar 2 and the body 13. Once the stop collar 2 has been positioned into the groove 3*g* of the body 13 (in a similar fashion as discussed above for the first centralizer 1), the stop collar 2 may be actuated into engagement with the downhole tubular 4 using a second assembly tool 14.

The second assembly tool 14 may include a housing 15, a mandrel 16, a sleeve 17, and a linear actuator. The linear actuator may include a plurality (pair shown) bolts 18, a hole formed through one of the flanges 15*f*,16*f*, such as the housing flange 15*f*, for each bolt, and a threaded socket formed through the other one of the flanges, such as the mandrel flange 16*f*, for each bolt. Each bolt 18 may have an enlarged head formed at a lower longitudinal end thereof and a shaft extending from the head to an upper longitudinal end thereof. The head of each bolt 18 may have a polygonal wrench profile formed at the lower longitudinal end thereof and an enlarged washer formed at the interface between the head and the shaft thereof. A portion of the shaft of each bolt 18 adjacent to the upper longitudinal end thereof may have a screw thread, such as a lead screw, formed in an outer surface thereof. Each member of the bolt 18 may be integrally formed. Each bolt hole of the housing flange 15*f* may have a diameter slightly greater than an outer diameter of the respective bolt shaft to form a clearance fit therebetween.

Alternatively, the linear actuator may include a plurality of hydraulic actuators, such as piston and cylinder assemblies, instead of bolts 18. Alternatively, the linear actuator may include a plurality of cam levers instead of bolts 18. Alternatively, the washer of each bolt 18 may be a separate member instead of integrally formed with the rest of the bolt.

Each of the housing 15 and the mandrel 16 may be cylindrical and have a bore formed therethrough. The housing 15 may have a cap 15*c* formed at a lower longitudinal end thereof, a flange 15*f* formed at an upper longitudinal end thereof, and a tube 15*t* connecting the cap and the flange. The mandrel 16 may have a tube 16*t* extending from a lower longitudinal end thereof to a cap 16*c*, a flange 16*f* extending from the tube at a mid portion thereof, and the cap formed at an upper longitudinal end thereof. To facilitate operation of the second assembly tool 14, the mandrel 16 may further have a plurality of windows formed through the tube 16*t* thereof to allow for visual monitoring. Each member 15*c*, 15*t*, 15*f* of the housing 15 may be integrally formed and each member 16*c*, 16*t*, 16*f* of the mandrel 16 may be integrally formed. Each cap 15*c*, 16*c* and the sleeve 17 may have an inner diameter slightly greater than the outer diameter of the downhole tubular 4 to form a clearance fit therebetween.

The sleeve 17 may have an enlarged head formed at a lower longitudinal end thereof and a stem extending from the head to an upper longitudinal end thereof. Each member of the sleeve 17 may be integrally formed. The housing cap 15*c* may have a recess formed at an upper face thereof for receiving the head of the sleeve 17. An inner diameter of the housing tube 15*t* may be slightly greater than an outer diameter of the mandrel tube 16*t* to form a clearance fit therebetween. An inner diameter of the first portion of the body 13 may be slightly greater than an outer diameter of the stem portion of the sleeve 17 to form a clearance fit therebetween. A length of the stem portion of the sleeve 17 may be sufficient to reach the groove 3*g* and actuate the stop collar 2 into engagement with the downhole tubular 4. An inner diameter of the mandrel tube 16*t* may be slightly greater than an effective diameter of the blades 3*b* form a clearance fit therebetween. The flanges 15*f*, 16*f* may have similar or identical outer diameters for interaction with the bolts 18.

The second assembly tool 14 may be installed by first inserting the sleeve 17 into the lower end of the body 13 until an upper end of the stem thereof engages the first cam ring 5. The mandrel 16 may then be slid over the upper end of the body 13 until a lower face of the cap 16*c* thereof engages an upper end of the body. The housing 15 may then be slid over the lower end of the mandrel 16 and along a lower portion of the tube until the head of the sleeve 17 is received into the recess of the upper face of the housing cap 15*c*. The holes of the housing flange 15*f* may be aligned with the threaded sockets of the mandrel flange 16*f* by rotation of one or both of the housing 15 and the mandrel 16. The shafts of the bolts 18 may then be inserted through the holes of the housing flange 15*f* and engaged with the threaded sockets of the mandrel flange 16*f* and rotated in a tightening direction using one or more wrenches (not shown), such as impact wrenches, until the washers of the bolts engage a lower face of the housing flange. The second centralizer 12 with the disengaged stop collar 2 and the installed second assembly tool 14 may then be slid over the downhole tubular 4 until the second centralizer is in a desired position along the downhole tubular 4.

Figure 5B:
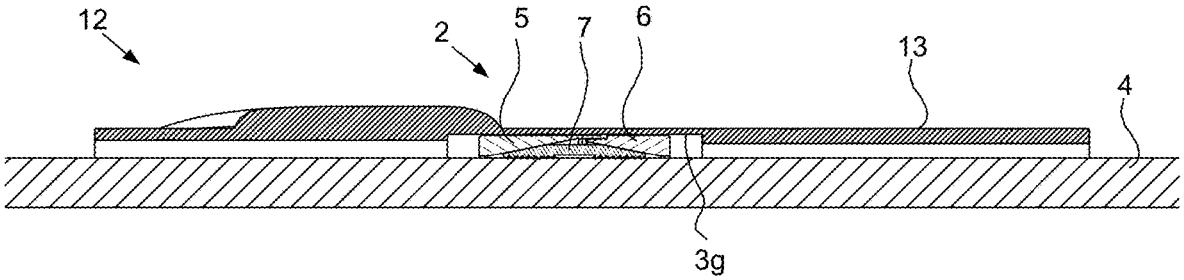
FIG. 5B illustrates the second centralizer equipped with the stop collar.

FIG. 5B illustrates the second centralizer 12 equipped with the stop collar 2. Once the disengaged stop collar 2 has been positioned along the downhole tubular 4, the wrenches may then be used again to rotate the bolts 18 in the tightening direction, thereby driving the flanges 15*f*, 16*f* toward each other and advancing the sleeve 17 into the body 13. Advancement of the sleeve 17 into the body 13 may be continued until the slip ring 7 is radially compressed to drive the teeth 7*t* thereof into the periphery of the downhole tubular 4 and the teeth of the ratchet profile 5*r* are engaged with the teeth of the ratchet profile 6*r* in a similar fashion as discussed above.

Figure 6B:
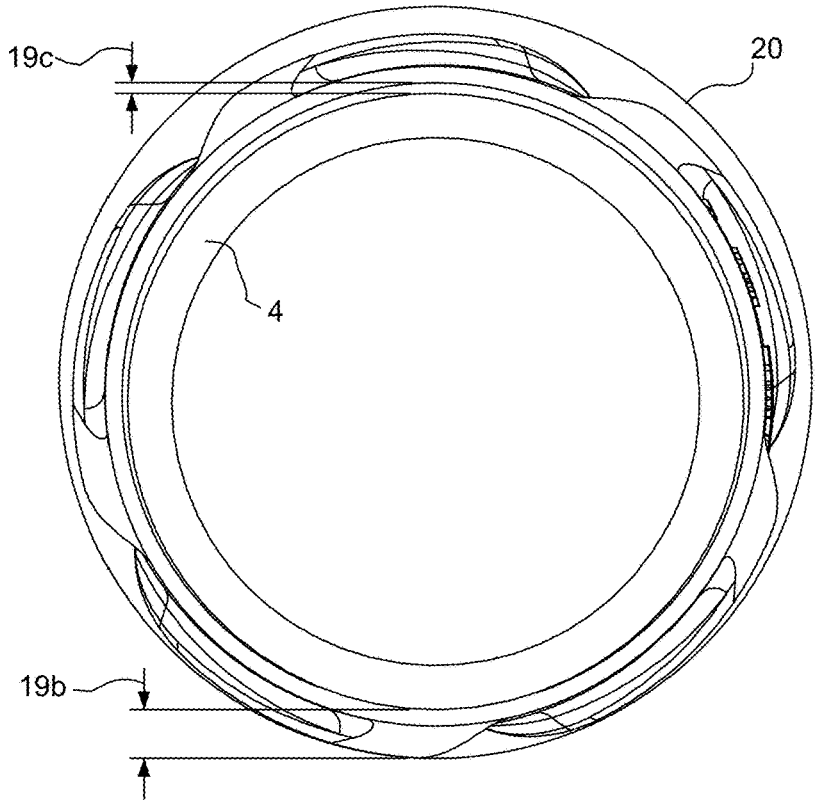
FIG. 6B (PRIOR ART)

FIGS. 6A and 6B illustrate improved standoff capability of the centralizers 1, 12 as compared to a prior art centralizer requiring a pair of external stop collars (FIG. 6B). As the prior art centralizer engages the downhole tubular 4, the clearance 19*c* between the body thereof and the downhole tubular 4 results in a loss of standoff 19*b* between the downhole tubular 4 and the wellbore 20. Advantageously, since the stop collar 2 occupies the clearance 19*c* (except for the addition of a much smaller rotational clearance 11*r*), the centralizers 1, 12 do not suffer the loss of standoff therefrom and enjoy a larger standoff 19*a*. The larger standoff 19*a* facilitates improved quality of the cement between downhole tubular 4 and the wellbore 20.

Further advantageously, the centralizers 1, 12, as compared to the prior art centralizer requiring the pair of the external stop collars straddling the centralizer, reduce complexity during installation onto the downhole tubular and requires less parts, thereby saving time and reducing cost.

While the foregoing is directed to embodiments of the present disclosure, other and further embodiments of the disclosure may be devised without departing from the basic scope thereof, and the scope of the invention is determined by the claims that follow.

The invention claimed is:

1. A centralizer for mounting onto a downhole tubular, comprising:

a cylindrical body having:

a plurality of blades forming a periphery thereof, a first portion with an inner surface, and a second portion having a groove formed in an inner surface thereof for receiving a stop collar; and the stop collar, comprising:

a compressible slip ring having teeth formed in an inner surface thereof and a pair of tapered outer surfaces, and a pair of cam rings, each cam ring having a tapered inner surface, wherein:

an outer diameter of each cam ring is greater than a diameter of the inner surface of the first portion and less than a diameter of the groove, an assembly tool is operable to drive the tapered surfaces together, thereby compressing the slip ring such that the teeth engage a periphery of the downhole tubular, the body further has a third portion having a constant and reduced inner diameter relative to the second portion, the second portion is located between the first and third portions, the groove is bounded by a pair of stop shoulders, and one of the cam rings engages one of the stop shoulders while driving the tapered surfaces together.

2. The centralizer of claim 1, wherein:

the stop collar further comprises a locking system, the locking system is operable to engage while the tapered surfaces are driven together, and the locking system is operable to prevent separation of the tapered surfaces.

3. The centralizer of claim 2, wherein the locking system comprises a pair of mateable ratchet profiles, each ratchet profile formed adjacent to an end of a respective cam ring.

4. The centralizer of claim 1, wherein:

a clearance is formed between an outer surface of the cam rings and an inner surface of the groove, and the clearance is sufficient so that the downhole tubular is freely rotatable relative to the centralizer body.

5. The centralizer of claim 1, wherein:

a length of the groove is greater than an engaged length of the stop collar, thereby forming a gap between the stop collar and the stop shoulders.

6. The centralizer of claim 1, wherein:

the body is made from a non-ferrous metal or alloy, and the stop collar is made from steel.

7. The centralizer of claim 1, wherein each cam ring has a solid wall without slots and without splits.

8. The centralizer of claim 1, wherein the blades and the body are constructed as one-piece.

9. The centralizer of claim 1, wherein:

the first portion of the cylindrical body has a threaded inner surface, the threaded inner surface has a major diameter and a minor diameter, an outer diameter of each cam ring is greater than the minor diameter of the threaded inner surface, and screwing the assembly tool into the threaded surface is operable to drive the tapered surfaces together.

10. The centralizer of claim 9, wherein:

the centralizer further comprises the assembly tool having a head portion with an enlarged outer diameter and a shank portion with a reduced outer diameter, the shank portion has a threaded outer surface mateable with the threaded inner surface of the body, and the assembly tool is cylindrical.

11. The centralizer of claim 1, wherein:

the centralizer further comprises the assembly tool, the assembly tool comprises a housing, a mandrel, a sleeve, and a linear actuator, the sleeve is insertable into the body for engagement with one of the cam rings, the mandrel has a bore for receiving the body and a cap for engagement with an end of the body, the housing has a face operable to engage the sleeve, each of the housing and the mandrel have a flange, and the linear actuator is operable to drive the flanges toward each other, thereby advancing the sleeve into the body.

12. A centralizer for mounting onto a downhole tubular, comprising:

a cylindrical body having:

a plurality of blades forming a periphery thereof, a first portion with an inner surface, and a second portion having a groove formed in an inner surface thereof for receiving a stop collar; and the stop collar, comprising:

a compressible slip ring having teeth formed in an inner surface thereof and a pair of tapered outer surface, and a pair of cam rings, each cam ring having a tapered inner surface, wherein:

an outer diameter of each cam ring is greater than a diameter of the inner surface of the first portion and less than a diameter of the groove, an assembly tool is operable to drive the tapered surface together, thereby compressing the slip ring such that the teeth engage a periphery of the downhole tubular, the centralizer further comprises the assembly tool, the assembly tool comprises a housing, a mandrel, a sleeve, and a linear actuator, the sleeve is insertable into the body for engagement with one of the cam rings, the mandrel has a bore for receiving the body and a cap for engagement with an end of the body, the housing has a face operable to engage the sleeve, each of the housing and the mandrel have a flange, and the linear actuator is operable to drive the flanges toward each other, thereby advancing the sleeve into the body.

* * * * *